US008814288B2

(12) United States Patent
McDaniel et al.

(10) Patent No.: US 8,814,288 B2
(45) Date of Patent: Aug. 26, 2014

(54) VARIABLE HEIGHT SLIDE-OUT RACK FOR APPLIANCE

(75) Inventors: Aaron Matthew McDaniel, Louisville, KY (US); Eric Scott Johnson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 193 days.

(21) Appl. No.: 13/280,449

(22) Filed: Oct. 25, 2011

(65) Prior Publication Data

US 2013/0099646 A1 Apr. 25, 2013

(51) Int. Cl.
*A47B 81/00* (2006.01)

(52) U.S. Cl.
USPC ..... 312/410; 312/319.1

(58) Field of Classification Search
USPC ..... 312/410, 408, 319.1, 319.3, 334.4, 266, 312/267, 269; 108/106, 144.11, 146, 147, 108/147.11; 211/153, 126.15, 90.01, 46, 211/150, 162, 103, 187, 190, 207
See application file for complete search history.

(56) References Cited

U.S. PATENT DOCUMENTS

| | | | | |
|---|---|---|---|---|
| 2,998,290 | A * | 8/1961 | Sharpe | 312/303 |
| 3,316,044 | A * | 4/1967 | Carbary | 312/408 |
| 4,217,010 | A * | 8/1980 | Webb | 312/407 |
| 5,308,158 | A * | 5/1994 | Vogelgesang et al. | 312/319.3 |
| 7,370,686 | B2 * | 5/2008 | Rasmussen | 160/323.1 |
| 8,100,488 | B2 * | 1/2012 | Eisele et al. | 312/408 |
| 2004/0195945 | A1 * | 10/2004 | Farber et al. | 312/408 |
| 2010/0066227 | A1 * | 3/2010 | Ramm et al. | 312/408 |
| 2011/0031863 | A1 * | 2/2011 | Benitsch et al. | 312/408 |

FOREIGN PATENT DOCUMENTS

| | | | |
|---|---|---|---|
| EP | 2285182 | A1 | 2/2011 |
| KR | 90-003488 | B1 | 5/1990 |

* cited by examiner

*Primary Examiner* — Darnell Jayne
*Assistant Examiner* — Andres F Gallego
(74) *Attorney, Agent, or Firm* — Global Patent Operation; Douglas D. Zhang

(57) ABSTRACT

An apparatus includes a shelf and a support structure for supporting the shelf, the support structure including rotation features that cause the shelf to rotationally pivot from a first height position to a second height position in response to a user-provided force. The rotation features include two pairs of wheels, wherein one of the pairs of wheels is attached to one side of the support structure and another one of the pairs of wheels is attached to another side of the support structure, each pair of wheels comprising a front wheel and a rear wheel.

16 Claims, 4 Drawing Sheets

VARIABLE HEIGHT SLIDE-OUT RACK FOR APPLIANCE

BACKGROUND OF THE INVENTION

The subject matter disclosed herein relates to appliances such as ovens, and more particularly to variable height slide-out racks for use in appliances such as ovens.

Oven racks are shelves that support food and/or cookware containing food inside the oven compartment while the food cooks or is otherwise stored in the oven. Traditional oven racks are known to be removable and adjustable in height. Typically, there are horizontal channels or other supports formed on the inside walls of the oven that hold the rack in place at a given height. There are typically supports at different height positions to allow for more than one rack to be in the oven supporting the food/cookware at the same time, and for the one or more racks to be repositioned in height.

Traditionally, to adjust the height of a rack, a consumer has to fully remove the rack from the oven compartment and then install it in a new rack height position. Depending on the location of the oven (e.g., a lower oven that is part of a freestanding range), this existing rack arrangement requires the consumer to bend down, pull the rack fully out of the oven, hold the rack, realign the rack, and then push the rack back into the oven. It is known that some oven racks can be as heavy as 15-22 pounds, making this existing rack removal and adjustment arrangement quite burdensome, not to mention time consuming as well.

BRIEF DESCRIPTION OF THE INVENTION

As described herein, the exemplary embodiments of the present invention overcome one or more disadvantages known in the art.

One aspect of the present invention relates to an apparatus comprising a shelf and a support structure for supporting the shelf, the support structure comprising rotation features that cause the shelf to rotationally pivot from a first height position to a second height position in response to a user-provided force.

Another aspect of the present invention relates to an appliance comprising an appliance compartment and an assembly. The assembly comprises an appliance shelf and a support structure for supporting the appliance shelf, the support structure comprising rotation features that cause the appliance shelf to rotationally pivot from a first height position to a second height position in response to a user-provided force.

In one embodiment, the rotation features may comprise two pairs of wheels, wherein one pair of wheels is attached to one side of the support structure and another pair of wheels is attached to another side of the support structure, each pair of wheels comprising a front wheel and a rear wheel. The support structure may further comprise a pair of slides, wherein one slide of the pair of slides is attached to one pair of wheels and another slide of the pair of slides is attached to the other pair of wheels, the appliance shelf being supported by the pair of slides. Thus, upon application of the user-provided force, the appliance shelf rotationally pivots around respective axes of the pair of slides as the pair of slides rotate around respective axes of the two pairs of wheels.

Further, in one embodiment, the support structure may further comprise a roller, and each of the front wheels of the two pairs of wheels may comprise a set of grooves, and wherein the appliance shelf is locked in either the first height position or the second height position when the roller is engaged in one of the set of grooves of the front wheels.

Still further, in one embodiment, the support structure may further comprise at least one spring attached to at least one of the rear wheels to provide a counterbalance to a weight associated with the appliance shelf and the support structure.

Advantageously, illustrative embodiments of the present invention provide the ability to adjust an appliance rack (e.g., an oven rack) into one of two height positions, high and low, without removing the rack from the appliance and with minimum user effort and time.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more illustrative embodiments of the invention will be described below in the context of an oven appliance. However, it is to be understood that embodiments of the invention are not intended to be limited to use with any particular appliances. Rather, embodiments of the invention may be applied to and deployed in any other suitable environment in which it would be desirable to provide for quick and easy height adjustment of a support shelf.

As illustratively used herein, the term "appliance" is intended to refer to a device or equipment designed to perform one or more specific functions. This may include, but is not limited to, equipment for consumer use, e.g., a wall-mounted oven, a freestanding cooking range, a refrigerator, a dishwasher, a microwave oven, etc. This may include, but is not limited to, any equipment that is useable in household or commercial environments.

Illustrative embodiments of the invention provide apparatus, systems and methods that provide the user with the ability to adjust an appliance rack into one of two height positions, high and low, without removing the rack from the appliance and with minimum user effort and time. As will be evident in the illustrative embodiments described below, the quick-adjust feature allows the user to quickly adjust the rack with a slight upward lift and a pull then push (C-shaped) motion on the front of the rack. The lift, pull and push motions are considered user-provided forces. This C-shaped motion rotationally pivots the rack assembly to the alternate height position. The rack locks in place when it comes to rest in the new position.

This quick-adjust feature is also advantageous when the user wishes to change the height position of the rack when the oven is on and thus the rack assembly is hot to the touch. That is, with the quick-adjust feature, the user need only grip the rack height position adjust handle (presumably using an insulating glove or cloth) to make the height adjustment, rather than having to grip and hold the entire rack with the existing arrangements that require the rack to be completely removed from the oven.

In addition, the quick-adjust rack assembly is able to extend horizontally out from the oven compartment so that the food/cookware can be more easily accessible to the user. Furthermore, the quick-adjust rack is otherwise removable from the oven compartment, e.g., for cleaning or storage.

Figure 1:
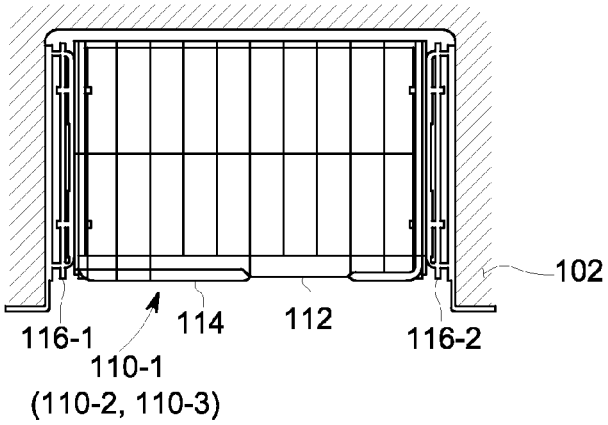
FIG. 1 is a diagram of a top view of an oven compartment with multiple quick-adjust rack assemblies, according to an embodiment of the invention.
Figure 2:
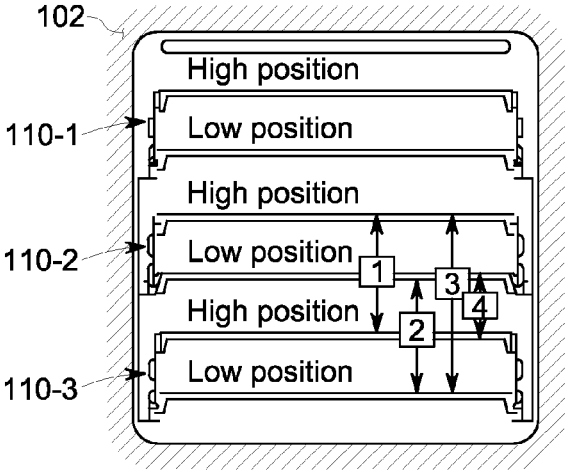
FIG. 2 is a diagram of a front view of an oven compartment with multiple quick-adjust rack assemblies, according to an embodiment of the invention.
Figure 3:
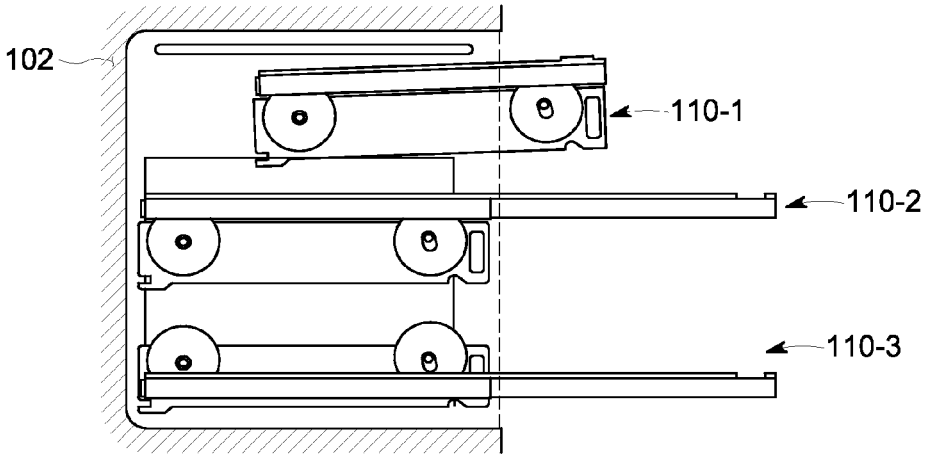
FIG. 3 is a diagram of a side view of an oven compartment with multiple quick-adjust rack assemblies, according to an embodiment of the invention.

FIGS. 1, 2 and 3 are diagrams of top, front and side views, respectively, of an oven compartment with multiple quick-adjust rack assemblies, according to an embodiment of the invention. More particularly, as shown in the figures, oven compartment 102 has installed therein three quick-adjust rack assemblies 110-1, 110-2 and 110-3, each formed in accordance with an embodiment of the invention.

Each rack assembly, as shown in FIG. 1, includes a rack height position adjust handle 112, a rack slide-out handle 114, and a pair of rack remove handles 116-1 (left) and 116-2 (right). The slide-out handle 114 allows the user to pull the rack assembly 110 straight out to extend the rack outside of the oven compartment 102. The pair of remove handles 116-1, 116-2 allows the user to completely remove the rack assembly 110 from the oven compartment 102. The height position adjust handle 112 allows the user to quickly and easily adjust the height of the rack assembly 110 from a first height position to a second height position, as will be explained in detail below.

Note that FIG. 2 (front view) simultaneously shows what each of the three rack assemblies 1104, 110-2 and 110-3 would look like in each height position, i.e., a high (upper) position and a low (lower) position. Of course, the user would not see this view as it is for explanatory purposes only and since a given rack 110 can only rest in one height position at a time (either high position or low position).

The numbers 1, 2, 3 and 4 in FIG. 2 correspond to four alternate configurations of the two rack assemblies 110-2 and 110-3. Configuration 1 has both rack assemblies 110-2 and 110-3 in the high position. Configuration 2 has both rack assemblies 110-2 and 110-3 in the low position. Configuration 3 has rack assembly 110-2 in the high position and rack assembly and 110-3 in the low position. Configuration 4 has rack assembly 110-2 in the low position and rack assembly and 110-3 in the high position.

FIG. 3 shows a side view of rack assembly 110-1 being removed, rack assembly 110-2 in the high (and extended) position, and rack assembly 110-3 in the low (and extended) position.

Figure 4:
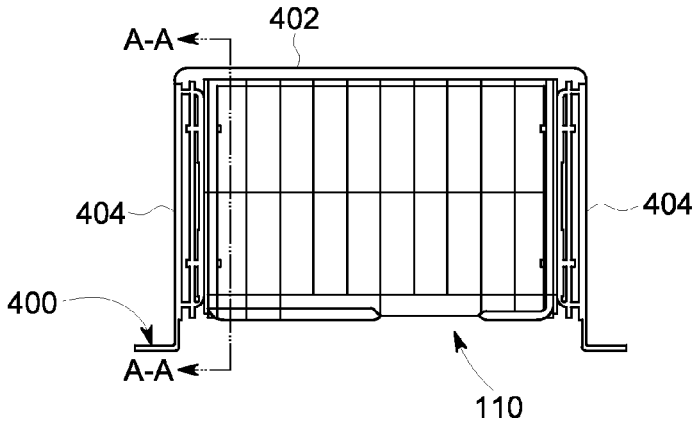
FIG. 4 is a diagram of a top view of a quick-adjust rack assembly, according to an embodiment of the invention.
Figure 5:
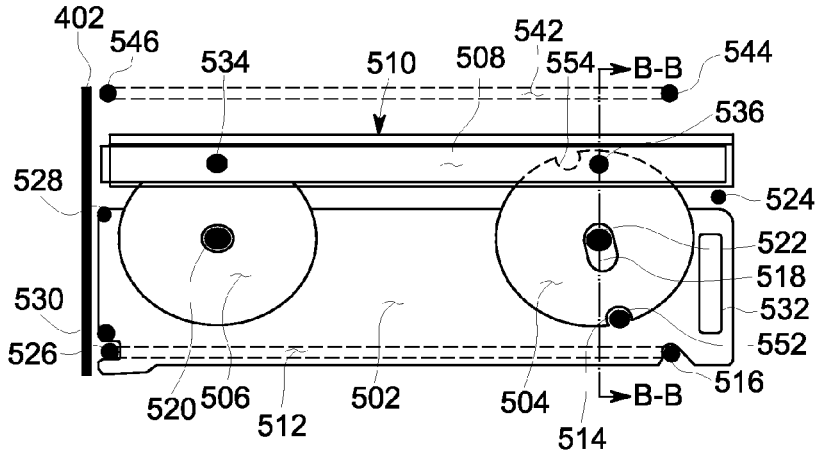
FIG. 5 is a diagram of a side view of a quick-adjust rack assembly, according to an embodiment of the invention.
Figure 6:
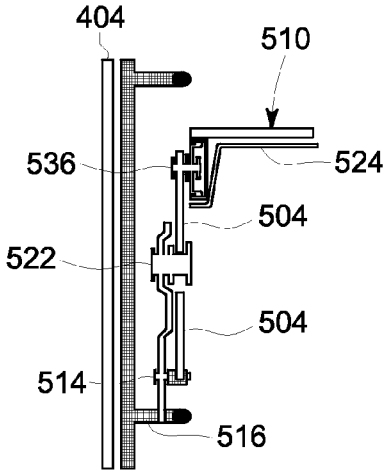
FIG. 6 is a diagram of a front view of a quick-adjust rack assembly, according to an embodiment of the invention.
Figure 7A:
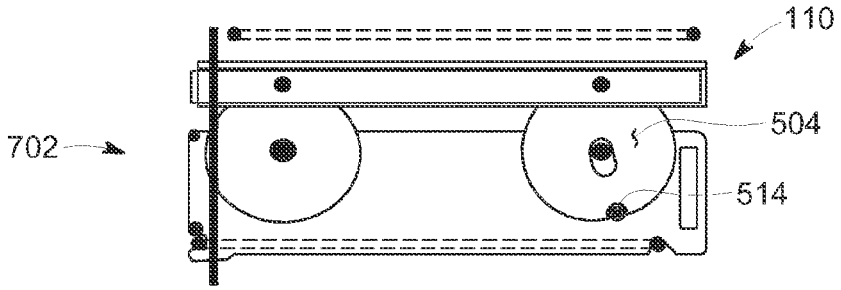
FIG. 7*a-d* are diagrams of a methodology for adjusting the height of a quick-adjust rack assembly, according to an embodiment of the invention.
Figure 7B:
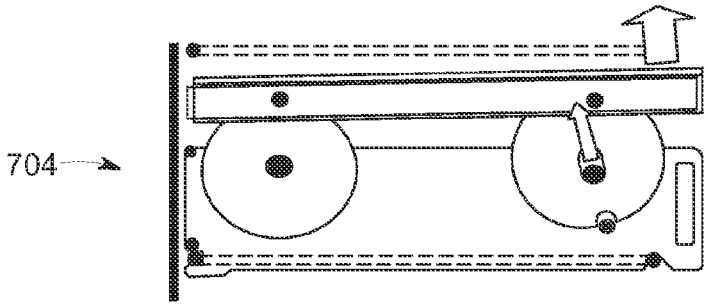
Figure 7C:
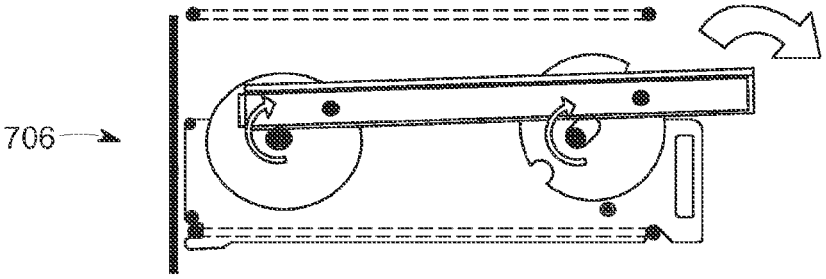
Figure 7D:
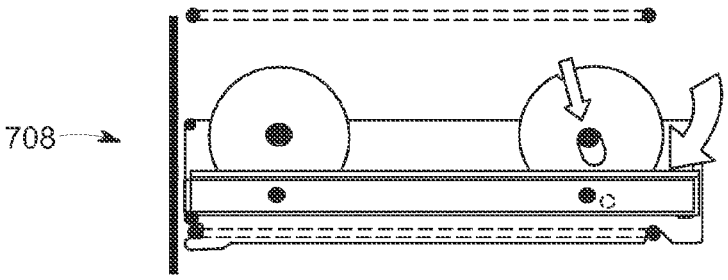

FIGS. 4, 5 and 6 are diagrams of top, side and front views, respectively, of a quick-adjust rack assembly, according to an embodiment of the invention. More particularly, FIGS. 4, 5 and 6 show various views of rack assembly 110 (e.g., 110-1, 110-2 or 110-3 in FIGS. 1-3).

FIG. 4 is a top view of the rack assembly 110 and references a cut-away view along line A-A. FIG. 5 is the side view of the rack assembly 110 viewed along the line A-A. Thus, while FIG. 5 shows the left side of the rack assembly 110, it is to be understood that the right side of the rack assembly 110 has the same components in a mirror-image configuration. Further, FIG. 5 references a cut-away view along line B-B, and FIG. 6 is a front view of the rack assembly 110 viewed along the line B-B.

FIG. 4 shows a cavity support shell 400 with cavity back wall 402 and cavity side walls 404. As will be evident, the rack assembly 110 is suspended in the oven compartment 102 by support bars that are fixed to the cavity side walls 404, as will be described below.

As shown, the rack assembly 110 includes a side plate 502, a front wheel 504, a rear wheel 506, a rack extension slide 508, an oven rack (shelf) 510, a roller 514, a front wheel oblong wheel-to-plate axis hole 518, a rear wheel axis 520, a front wheel axis 522, a front rod 524, an upper back rod 528, a lower back rod 530, a front handle 532, an extension slide back axis 534, and an extension slide front axis 536.

Functionality and interaction of the above components and features will now be described. However, it is to be understood that, while such functionality and component interaction is described below from the perspective of one side (left side) of the rack assembly 110, the other side (right side) is formed and functions/interacts in the same manner. Thus, one of ordinary skill in the art will realize that the left-side components of the assembly described below operate in conjunction/cooperation with the corresponding right-side components to provide the support and motion capabilities described herein.

Note that the rack assembly 110 may therefore be considered to comprise an appliance shelf (e.g., the oven rack 510) and a support structure (e.g., the above-mentioned rack assembly 110 components, other than the oven rack 510, including the corresponding components on the other side of the rack assembly 110 that are not shown in FIG. 5). The application shelf can be fixedly or releasably attached to the support structure.

The rack assembly 100 is supported in the oven compartment 102 via the side plate 502, a rack holder support bar 512, a bottom holder bar 516 and a plate back lock 526. As can be seen in FIG. 5, the side plate 502 has grooves formed therein to accommodate the bottom holder bar 516 and the plate back lock 526. The bottom holder bar 516 and the plate back lock 526 are attached to the rack holder support bar 512 which is fixed to the cavity side walls 404. Note that a second (identical) set of supports is shown in FIG. 5, i.e., a rack holder support bar 542, a bottom holder bar 544 and a plate back lock 546. These supports would hold a second rack assembly (not shown) in place above the rack assembly shown in FIG. 5.

The slide plate 502 also supports the rear wheel axis 520 and the front wheel axis 522. The front wheel 504 and the rear wheel 506, in turn, support the rack extension slide 508 by pivot points at the outer edges of the wheels, i.e., the extension slide back axis 534 and the extension slide front axis 536.

The extension slide 508 supports the oven rack 510 (actual shelf that food/cookware sits on). The connection between the extension slide 508 and the oven rack 510 can be a fixed one or a releasable one. The oven rack 510 slides out from the rack assembly via the extension slides (again, left side (shown) and right side (not shown)). The oven rack 510 has a handle formed therein to allow the user to slide the rack out to an extended position, and back again to a non-extended position. The oven rack handle is shown in FIG. 1 as handle 114.

The link (i.e., via the front and rear wheels 504, 506) between the support plate wheel axes 520, 522 and the slide pivot points (slide axes 534 and 536) allows for the rack to rotate (rotationally pivot) 180 degrees between an upper or high rack position and a lower or low rack position. The user performs this rotational pivot motion by gripping the front rod 524 (which corresponds to rack height position adjust handle 112 in FIG. 1). The front rod 524 also provides horizontal support for the oven rack 510.

The front wheel 504, in cooperation with the roller 514, is used to lock the rack assembly in the upper or lower position. To do so, the front wheel assembly comprises: the roller 514, the oblong wheel-to-plate axis hole 518, and two semi-circular notches 552 and 554 formed on the front wheel edge 180 degree apart.

The oblong wheel-to-plate axis hole 518 allows the front wheel 502 to move up if the shelf front is forced up (by the user providing a slight lift via front rod 524). The roller 514, located on the bottom side of the front wheel 504, keeps the assembly in a slightly tilted position when the wheel is in-between upper and lower positions (i.e., between 1 and 179 degrees). At the upper and lower positions, i.e., 0 and 180 degrees, respectively, the roller 514 aligns with one of the two wheel notches 552 or 554. This allows the front wheel 502 to drop down on the roller 514 locking the assembly into the selected height position.

Note that the rear wheel assembly 506 may have a feature to counterbalance the weight of the rack assembly 110 to make the rotational pivot motion even easier for the user. This feature will be described below in the context of FIGS. 8 and 9.

Note also that the front handle 532, formed in the side plate 502 and which corresponds to the left side remove handle 116-1 in FIG. 1, allows the user to grip, lift and remove the rack assembly 110 from the oven compartment 102.

FIG. 7*a-d*are diagrams of a methodology for adjusting the height of a quick-adjust rack assembly, according to an embodiment of the invention. Note that the components and features described in the methodology of FIG. 7*a-d* correspond to the components and features described above in the context of FIG. 1-6.

In step 702, it is assumed that the rack assembly 110 is in the high rack position. Recall that the roller 514 locks the front wheel 504, as described above, so that the rack assembly 110 is safely locked in this position.

In step 704, the user (consumer) lifts the rack assembly to the unlock position by lifting up on the rack position height adjust handle 112 (front rod 524). The roller 514 disengages from the front wheel 504 to allow the wheel to rotate.

In step 706, the user pulls and pushes the rack assembly in a C-shaped motion to rotationally pivot the assembly to the lower rack position. Note that the front wheel 504 rotates on the roller 514 during this clockwise rotation.

In step 708, when the wheel slot 552 or 554 and the roller 514 are aligned, the front wheel 504 drops down on the roller 514 locking the wheel. The rack assembly 110 is now in the low rack position.

It is to be understood that the lift and C-shaped motion is repeated (but now in the counterclockwise direction) when the rack assembly is to be returned to the high rack position.

Figure 8:
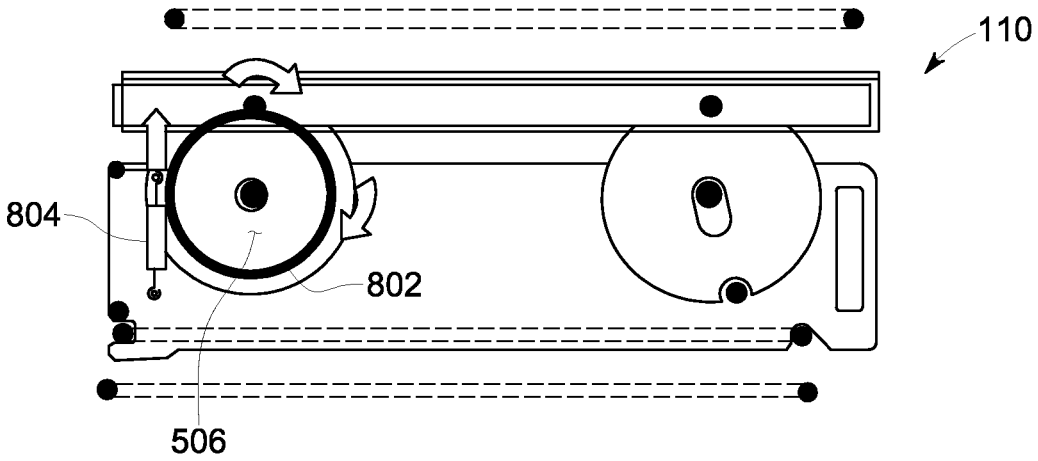
FIG. 8 is a diagram of a side view of a quick-adjust rack assembly with a counterbalance weight feature in a non-extended state, according to an embodiment of the invention.
Figure 9:
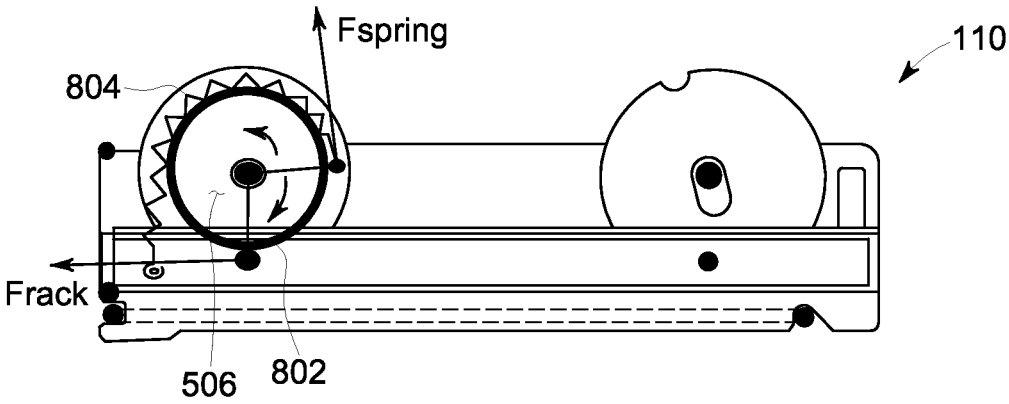
FIG. 9 is a diagram of a side view of a quick-adjust rack assembly with a counterbalance weight feature in an extended state, according to an embodiment of the invention.

FIGS. 8 and 9 are diagrams of a side view of a quick-adjust rack assembly with a counterbalance weight feature in a non-extended state (FIG. 8) and an extended state (FIG. 9), according to an embodiment of the invention.

As shown, the rear wheel assembly 506 in this embodiment also includes a rear wheel rib 802 and an extension spring 804. The rear wheel rib 802 serves as a surface for the extension spring 804 to rest as it stretches. Note that one end of the extension spring 804 is attached to the side plate 502 and the other end is attached to the rear wheel 506. Note also that an identical arrangement can be implemented on the other side (not shown) of the rack assembly 110.

It is realized that a spring helps offset the weight of the rack assembly 110 to provide greater ease to the consumer (less force required) when adjusting the rack assembly to the upper or lower position. In this illustrative embodiment, an extension spring is employed.

Note that the extension spring 804 rests on the wheel rib 802 as it stretches. As the rear wheel 506 rotates when the assembly is being adjusted (C-shaped motion) between height positions, the spring 804 is stretched and exerts a force proportional to its change in length in the opposite direction ($F_{spring}$). This force from the spring 804 provides a counter clockwise torque on the rear wheel 506. This counter clockwise torque offsets the clockwise torque due to the rack weight ($F_{rack}$).

It should be noted that other springs can also readily provide the same function with slight alterations to the configuration shown in FIGS. 8 and 9. Such slight alterations will be realized by those of ordinary skill in the art given the teachings herein. Examples of other springs include, but are not limited to, compression springs, torsion springs and barrel springs.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a shelf; and a support structure for supporting the shelf, the support structure comprising rotation features that cause the shelf to rotationally pivot from a first height position to a second height position in response to an applied force;

wherein the rotation features comprise two pairs of wheels, wherein one of the pairs of wheels is attached to one side of the support structure and another one of the pairs of wheels is attached to another side of the support structure, each pair of wheels comprising a front wheel and a rear wheel;

wherein the support structure further comprises a pair of slides, wherein one slide of the pair of slides is attached to one of the pairs of wheels and another slide of the pair of slides is attached to the other one of the pairs of wheels, the shelf being supported by the pair of slides;

wherein, upon application of the applied force, the shelf rotationally pivots around respective axes of the pair of slides as the pair of slides rotate around respective axes of the two pairs of wheels; and wherein the support structure further comprises a roller, and each of the front wheels of the two pairs of wheels comprises a set of grooves formed on respective curved outermost peripheral edges of the front wheels, and wherein the shelf is locked in either the first height position or the second height position when the roller is engaged in one of the set of grooves of the front wheels.

2. The apparatus of claim 1, wherein for each set of grooves, one of the set of grooves is 180 degrees apart from another of the set of grooves.

3. The apparatus of claim 2, wherein each of the front wheels comprises an oblong shaped axis hole that allows the front wheel to move upward when the applied force comprises an upward lifting force.

4. The apparatus of claim 3, wherein each front wheel rotates on the roller, when disengaged therefrom, when the applied force comprises a pulling force or a pushing force.

5. The apparatus of claim 1, wherein the support structure further comprises at least one spring attached to at least one of the rear wheels to provide a counterbalance to a weight associated with the shelf and the support structure.

6. The apparatus of claim 5, wherein the at least one spring wraps around a support rib formed on at least one of the rear wheels.

7. The apparatus of claim 1, wherein, when the first height position is above the second height position, the rotation is clockwise when adjusting the shelf from the first height position to the second height position, and counterclockwise when adjusting the shelf from the second height position to the first height position.

8. The apparatus of claim 1, wherein the set of grooves comprise semicircular notches formed on the respective curved outermost peripheral edges of the front wheels.

9. An appliance comprising:

an appliance compartment; and an assembly mounted in the appliance compartment, the assembly comprising: an appliance shelf; and a support structure for supporting the appliance shelf, the support structure comprising rotation features that cause the appliance shelf to rotationally pivot from a first height position to a second height position in response to an applied force;

wherein the rotation features of the support structure comprise two pairs of wheels, wherein one of the pairs of wheels is attached to one side of the support structure and another one of the pairs of wheels is attached to another side of the support structure, each pair of wheels comprising a front wheel and a rear wheel;

wherein the support structure further comprises a pair of slides, wherein one slide of the pair of slides is attached to one of the pairs of wheels and another slide of the pair of slides is attached to the other one of the pairs of wheels, the appliance shelf being supported by the pair of slides;

wherein, upon application of the applied force, the appliance shelf rotationally pivots around respective axes of the pair of slides as the pair of slides rotate around respective axes of the two pairs of wheels;

wherein the support structure further comprises a roller, and each of the front wheels of the two pairs of wheels comprises a set of grooves formed on respective curved outermost peripheral edges of the front wheels, and wherein the appliance shelf is locked in either the first height position or the second height position when the roller is engaged in one of the set of grooves of the front wheels.

10. The appliance of claim 9, wherein the support structure further comprises at least one spring attached to at least one of the rear wheels to provide a counterbalance to a weight associated with the appliance shelf and the support structure.

11. The appliance of claim 10, wherein the at least one spring wraps around a support rib formed on at least one of the rear wheels.

12. The appliance of claim 9, wherein, when the first height position is above the second height position, the rotation is clockwise when adjusting the appliance shelf from the first height position to the second height position, and counterclockwise when adjusting the appliance shelf from the second height position to the first height position.

13. The appliance of claim 9, wherein for each set of grooves, one of the set of grooves is 180 degrees apart from another of the set of grooves.

14. The appliance of claim 9, wherein the appliance is an oven appliance.

15. The appliance of claim 9, wherein the set of grooves comprise semicircular notches formed on the respective curved outermost peripheral edges of the front wheels.

16. An apparatus comprising:

a shelf; and a support structure for supporting the shelf, the support structure comprising rotation features that cause the shelf to rotationally pivot from a first height position to a second height position in response to an applied force;

wherein the rotation features comprise two pairs of wheels, wherein one of the pairs of wheels is attached to one side of the support structure and another one of the pairs of wheels is attached to another side of the support structure, each pair of wheels comprising a front wheel and a rear wheel;

wherein the support structure further comprises a pair of slides, wherein one slide of the pair of slides is attached to one of the pairs of wheels and another slide of the pair of slides is attached to the other one of the pairs of wheels, the shelf being supported by the pair of slides;

wherein, upon application of the applied force, the shelf rotationally pivots around respective axes of the pair of slides as the pair of slides rotate around respective axes of the two pairs of wheels;

wherein the support structure further comprises a roller, and each of the front wheels of the two pairs of wheels comprises a set of grooves, and wherein the shelf is locked in either the first height position or the second height position when the roller is engaged in one of the set of grooves of the front wheels;

wherein for each set of grooves, one of the set of grooves is 180 degrees apart from another of the set of grooves;

wherein each of the front wheels comprises an oblong shaped axis hole that allows the front wheel to move upward when the applied force comprises an upward lifting force;

wherein each front wheel rotates on the roller, when disengaged therefrom, when the applied force comprises a pulling force or a pushing force; and wherein the shelf and the support structure are maintained in an upward-tilted position when each front wheel rotates on the roller.

* * * * *